US006921888B2

(12) United States Patent
Ryu

(10) Patent No.: US 6,921,888 B2
(45) Date of Patent: Jul. 26, 2005

(54) MICROWAVE OVEN

(75) Inventor: Han-Gyu Ryu, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 75 days.

(21) Appl. No.: 10/454,593

(22) Filed: Jun. 5, 2003

(65) Prior Publication Data

US 2004/0149743 A1 Aug. 5, 2004

(30) Foreign Application Priority Data

Dec. 28, 2002 (KR) ..... 10-2002-0085718

(51) Int. Cl.[7] ..... H05B 6/68
(52) U.S. Cl. ..... 219/702; 219/756
(58) Field of Search ..... 219/702, 756, 219/734, 725, 720, 714; 340/825.52; 318/16

(56) References Cited

U.S. PATENT DOCUMENTS 4,816,635 A * 3/1989 Edamura ..... 219/714
5,646,608 A * 7/1997 Shintani ..... 340/825.52
6,106,576 A * 8/2000 Fromson ..... 318/16

FOREIGN PATENT DOCUMENTS

JP 58150721 A * 9/1983 ..... F24C/7/02
KR 2002042349 A * 6/2002 ..... F24C/7/00

OTHER PUBLICATIONS

Patent Abstracts of Japan for Publication No. 2001–099427, dated Apr. 13, 2001.
Patent Abstracts of Japan for Publication No. 2001–263675, dated Sep. 26, 2001.

* cited by examiner

*Primary Examiner*—Quang T. Van
(74) *Attorney, Agent, or Firm*—Staas & Halsey LLP

(57) ABSTRACT

A microwave oven designed to open or close a front of a control panel, and to either supply power to the microwave oven or shut off power, depending on whether the front of the control panel is opened or closed. The microwave oven includes a control panel provided with a plurality of control buttons. A cover unit is mounted to the control panel to open or close a predetermined portion of the control panel in which the control buttons are provided. A power switch either supplies power to the microwave oven or shuts off power, depending on whether the cover unit is opened or closed.

14 Claims, 6 Drawing Sheets

MICROWAVE OVEN

CROSS-REFERENCE TO RELATED APPLICATIONS

This application claims the benefit of Korean Application No. 2002-85718, filed Dec. 28, 2002, in the Korean Intellectual Property Office, the disclosure of which is incorporated herein by reference.

BACKGROUND OF THE INVENTION

1. Field of the Invention

The present invention relates, in general, to microwave ovens and, more particularly, to a microwave oven which is provided with a cover unit to open or close a front of a control panel.

2. Description of the Related Art

As is well known to those skilled in the art, a microwave oven is an appliance which cooks food using microwaves. The microwave oven cooks food by heating the interior of the food through a dielectric heating method. The microwave oven is provided with a cooking cavity into which food is laid, and a microwave heating device, known as a magnetron, which irradiates microwaves into the cooking cavity to cook the food.

A door is mounted to a front of the microwave oven to open or close the cooking cavity. The microwave oven also includes a machine room in which several electrical devices are installed. A control panel is mounted to a front of the machine room, and is provided with a plurality of control buttons to control the operation of the microwave oven, and a display to show the operating status of the microwave oven.

However, the conventional microwave oven has a problem in that the control buttons provided on the control panel are exposed to the outside, so the control buttons may become dirty due to dust in a room, and the microwave oven may be undesirably and carelessly operated by children. Further, the conventional microwave oven has another problem in that it is not frequently used even though power is constantly supplied to the microwave oven, so power consumption is unnecessarily high.

SUMMARY OF THE INVENTION

Accordingly, it is an aspect of the present invention to provide a microwave oven which is designed to open or close the front of a control panel with control buttons.

It is another aspect of the present invention to provide a microwave oven which is designed such that power is either supplied to the microwave oven or is shut off depending on whether the front of the control panel is opened or closed.

Additional aspects and advantages of the invention will be set forth in part in the description which follows and, in part, will be obvious from the description, or may be learned by practice of the invention.

The foregoing and/or other aspects of the present invention are achieved by providing a microwave oven, including a control panel provided with a plurality of control buttons, a cover unit mounted to the control panel to open or close a predetermined portion of the control panel in which the control buttons are provided, and a power switch to either supply power to the microwave oven or shut off power, depending on whether the cover unit is opened or closed.

The control buttons are provided on either of upper and lower portions of a front surface of the control panel. The cover unit has a size larger than a size of the portion of the control panel with the control buttons, and is mounted to the control panel in such a way as to be moved up and down by an elevating unit.

The elevating unit includes guide grooves longitudinally formed along both sidewalls of the control panel, bent parts formed by bending both side edges of the cover unit to cover the sidewalls of the control panel, and guide rails formed by bending edges of the bent parts to engage with the guide grooves.

A locking projection having predetermined elasticity is provided at an upper portion of the control panel to hold the cover unit when the cover unit moves upward, and a locking groove is provided on an inner surface of the cover unit to engage with the locking projection.

The power switch is depressed by the cover unit when the cover unit covers the control buttons so that the power to the microwave is shut off.

Further, according to the present invention, a microwave oven includes a control panel provided with a plurality of control buttons, and a cover unit slidably mounted to the control panel to open or close a predetermined portion of the control panel in which the control buttons are provided.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
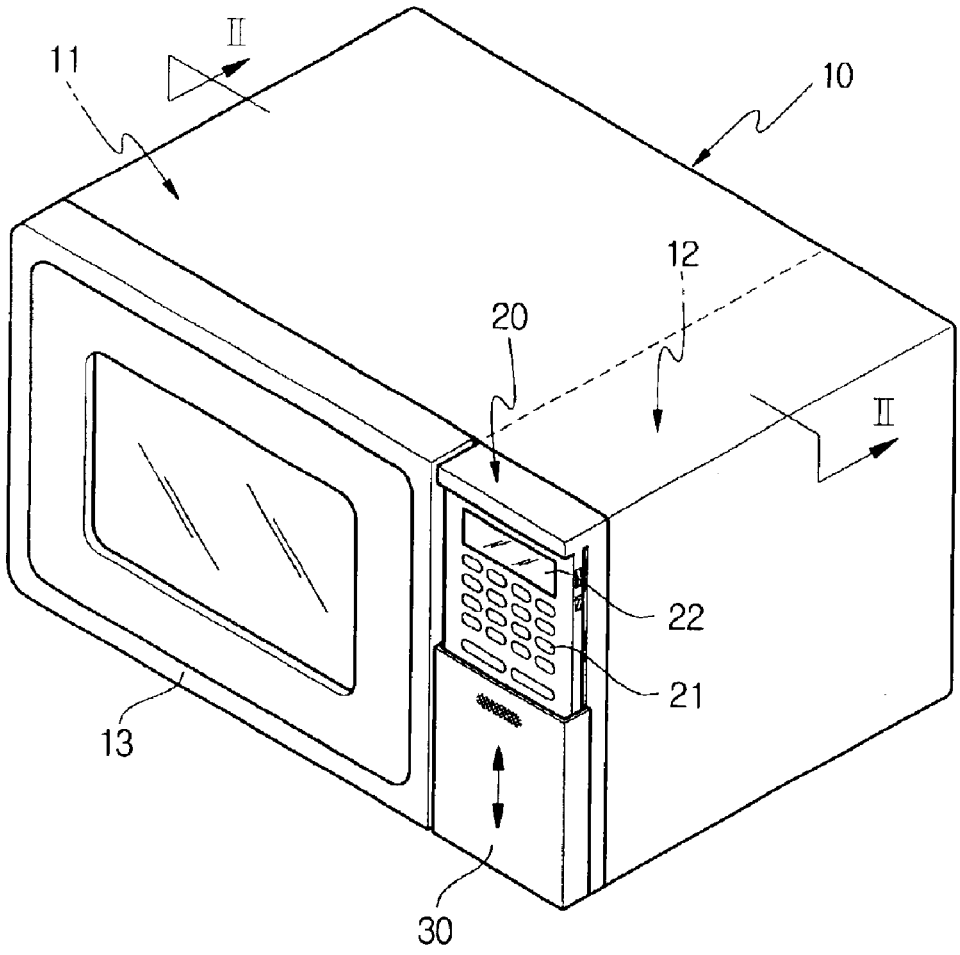
FIG. 1 is a perspective view of a microwave oven according to an embodiment of the present invention.

Reference will now be made in detail to the present preferred embodiments of the present invention, examples of which are illustrated in the accompanying drawings, wherein like reference numerals refer to like elements throughout.

Figure 2:
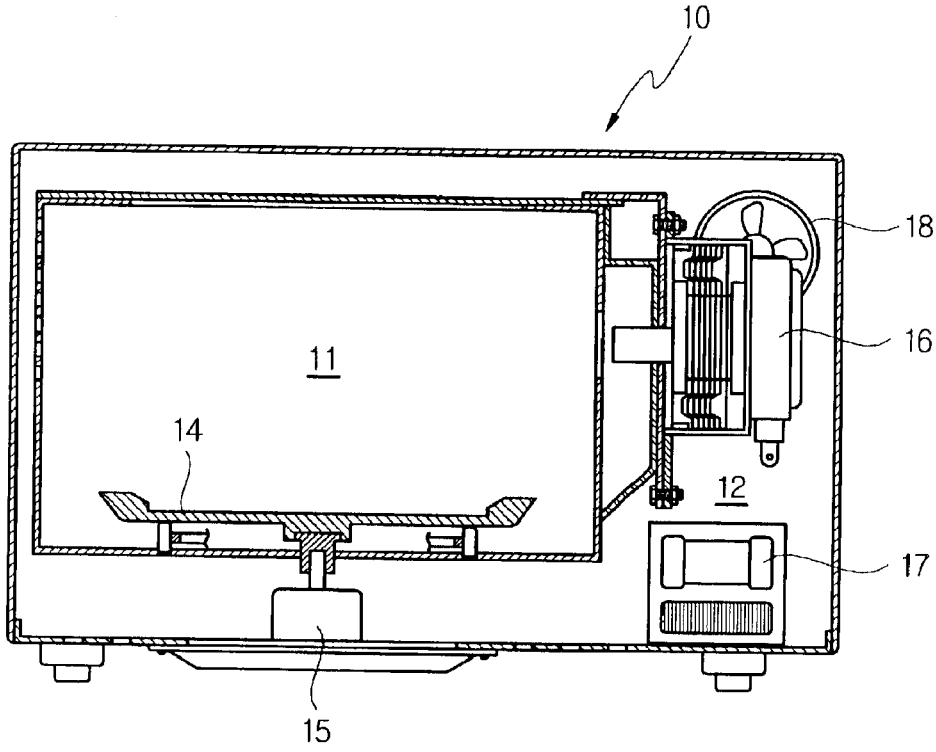
FIG. 2 is a sectional view taken along the line II–II' of FIG. 1.

As illustrated in FIGS. 1 and 2, a microwave oven according to the present invention includes a cabinet 10. The cabinet 10 is partitioned into a cooking cavity 11 into which food is laid, and a machine room 12 in which several electrical devices are installed. The cooking cavity 11 is opened at its front so that food is put in or taken from the cooking cavity 11. A door 13 is mounted to the front of the cooking cavity 11 to open or close it. A cooking tray 14 is rotatably installed in the cooking cavity 11. The food to be cooked is laid on the cooking tray 14. A drive motor 15 is installed between a bottom of the cooking cavity 11 and a bottom of the cabinet 10 under the cooking cavity 11 to rotate the cooking tray 14.

Several electrical devices, including a magnetron 16, a high-voltage transformer 17, and a cooling fan 18, are installed in the machine room 12. The magnetron 16 irradiates microwaves into the cooking cavity 11. The high-voltage transformer 17 applies high voltage to the magnetron 16. The cooling fan 18 functions to cool the machine room 12.

A control panel 20 is mounted to a front of the machine room 12, and is provided with a plurality of control buttons 21 to control the operation of the microwave oven, and a display 22 to show the operating status of the microwave oven. Further, according to the present invention, a cover unit 30 is mounted to the control panel 20 in such a way as to be slidably moved in a vertical direction, thus allowing a front of the control panel 20 to be opened or closed, as desired.

Figure 3:
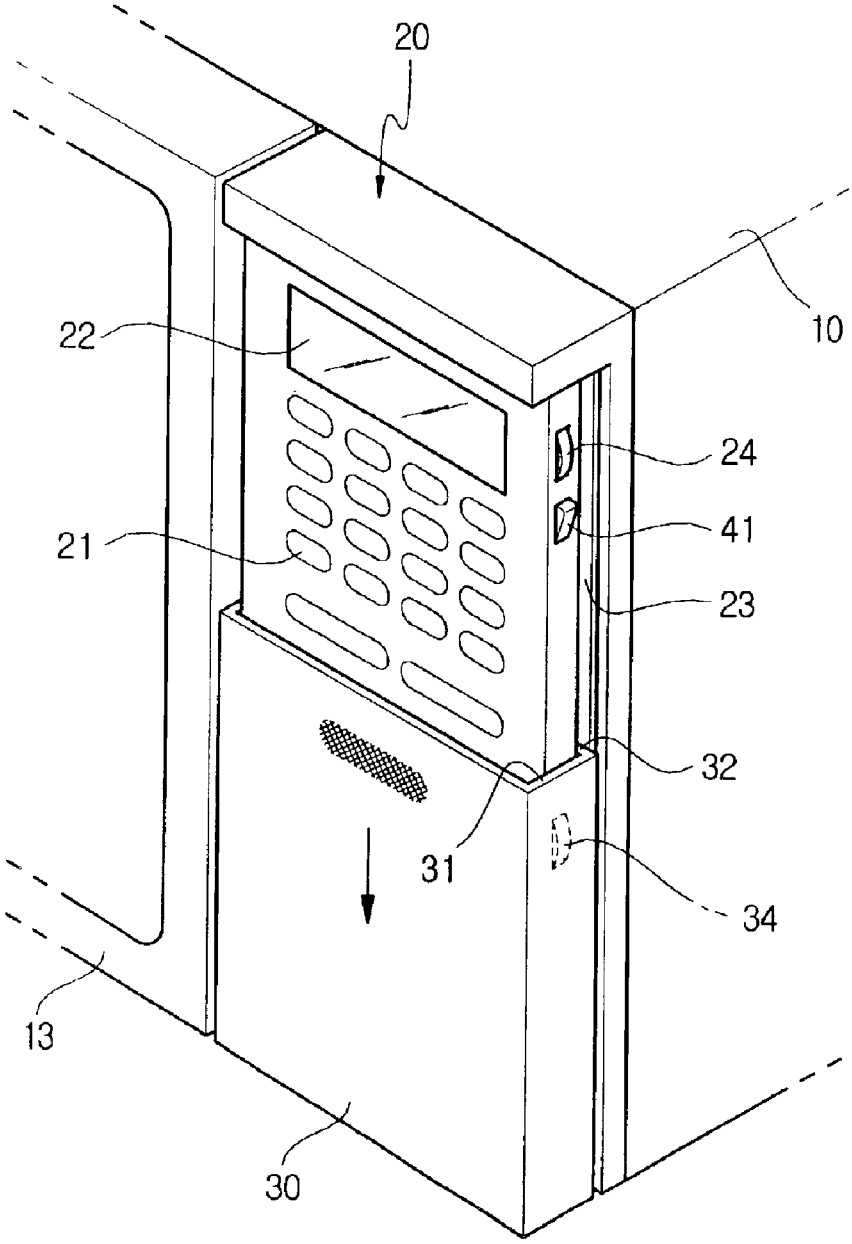
FIG. 3 is a perspective view illustrating a control panel of the microwave oven of FIG. 1, when a cover unit is in an opened position.
Figure 4:
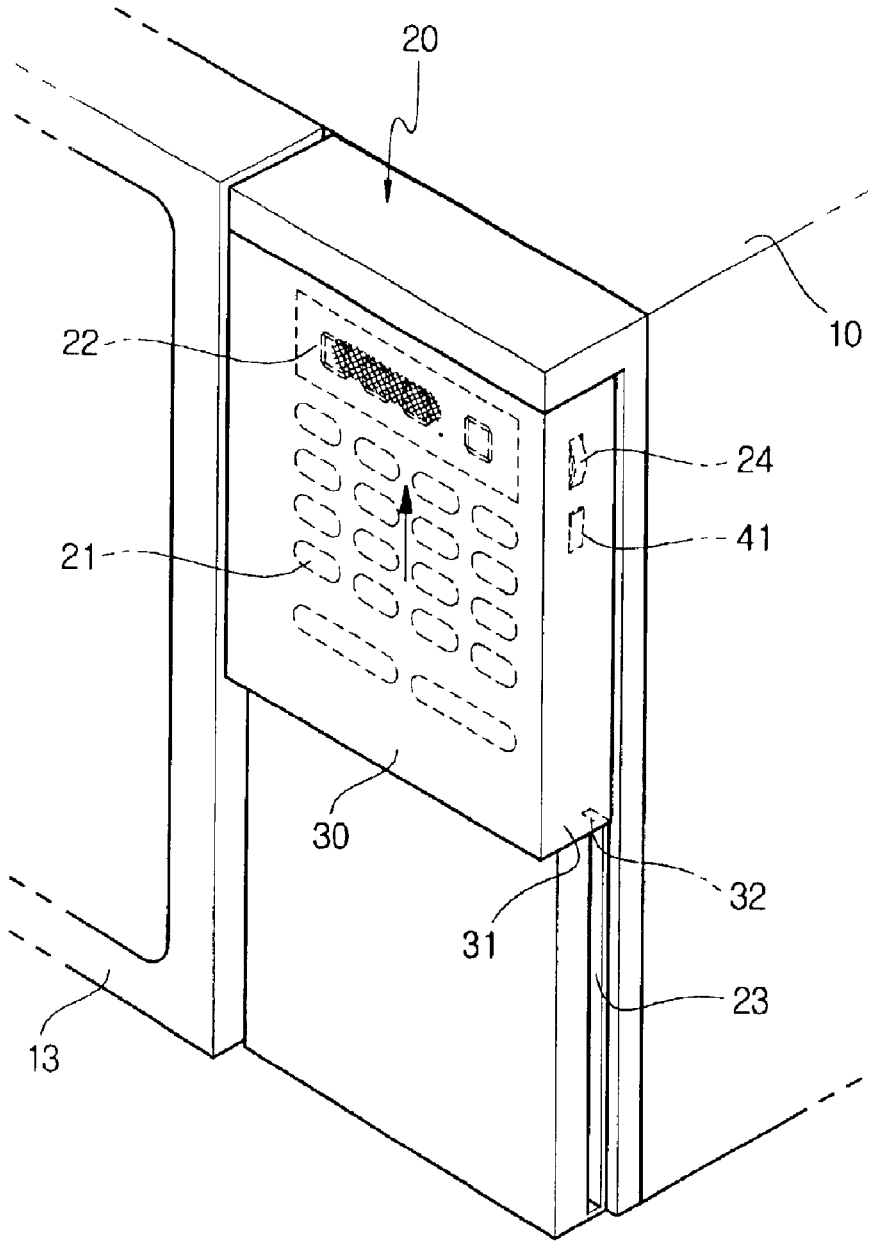
FIG. 4 is a perspective view illustrating the control panel of the microwave oven of FIG. 1, when the cover unit is in a closed position.

As illustrated in FIGS. 3 and 4, the control panel 20 has a size corresponding to that of the front of the machine room 12, and comprises a box-shaped panel which is provided with a circuit board (not shown). The control buttons 21 are provided on an upper portion of a front surface of the control panel 20 to control the operation of the microwave oven. The display 22 is provided above the control buttons 21 on the control panel 20 to display the operating status of the microwave oven, and comprises an LCD (Liquid Crystal Display).

The cover unit 30 has an area larger than that of the upper portion of the control panel 20 on which the control buttons 21 and the display 22 are provided. In this case, the cover unit 30 opens or closes the upper portion of the control panel 20 while being slidably moved in a vertical direction by an elevating unit. The elevating unit is provided on both sidewalls of the control panel 20 and both edges of the cover unit 30.

That is, the elevating unit includes guide grooves 23, bent parts 31, and guide rails 32. The guide grooves 23 are longitudinally formed along the sidewalls of the control panel 20. The bent parts 31 are formed by bending both side edges of the cover unit 30 to cover the sidewalls of the control panel 20. The guide rails 32 are formed by bending edges of the bent parts 31, and engage with the guide grooves 23 to be slidably moved along the guide grooves 23 in a vertical direction.

Figure 5:
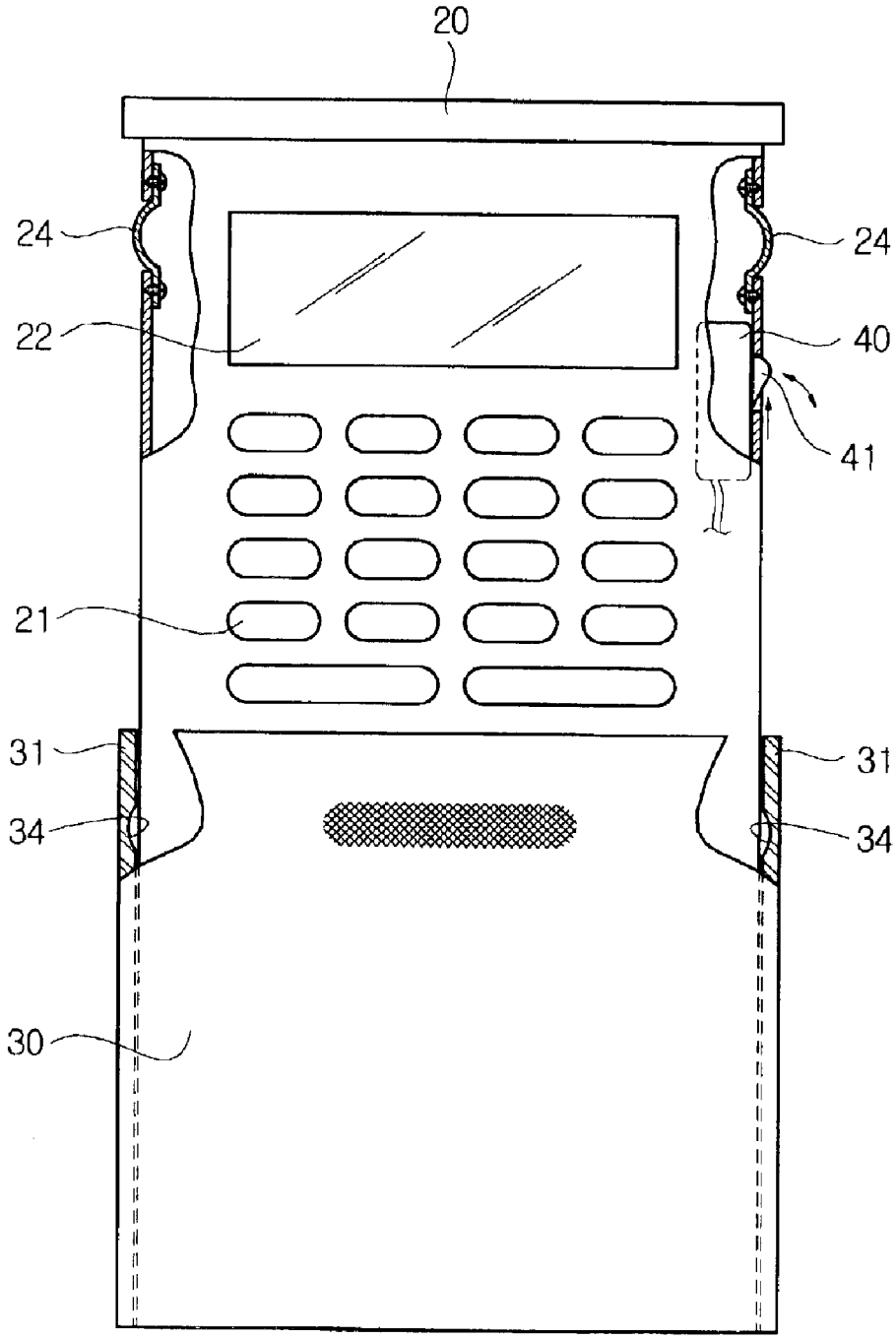
FIG. 5 is a sectional view illustrating a power switch and a locking projection which are provided on the control panel of the microwave oven of FIG. 1, when the cover unit is in the opened position.
Figure 6:
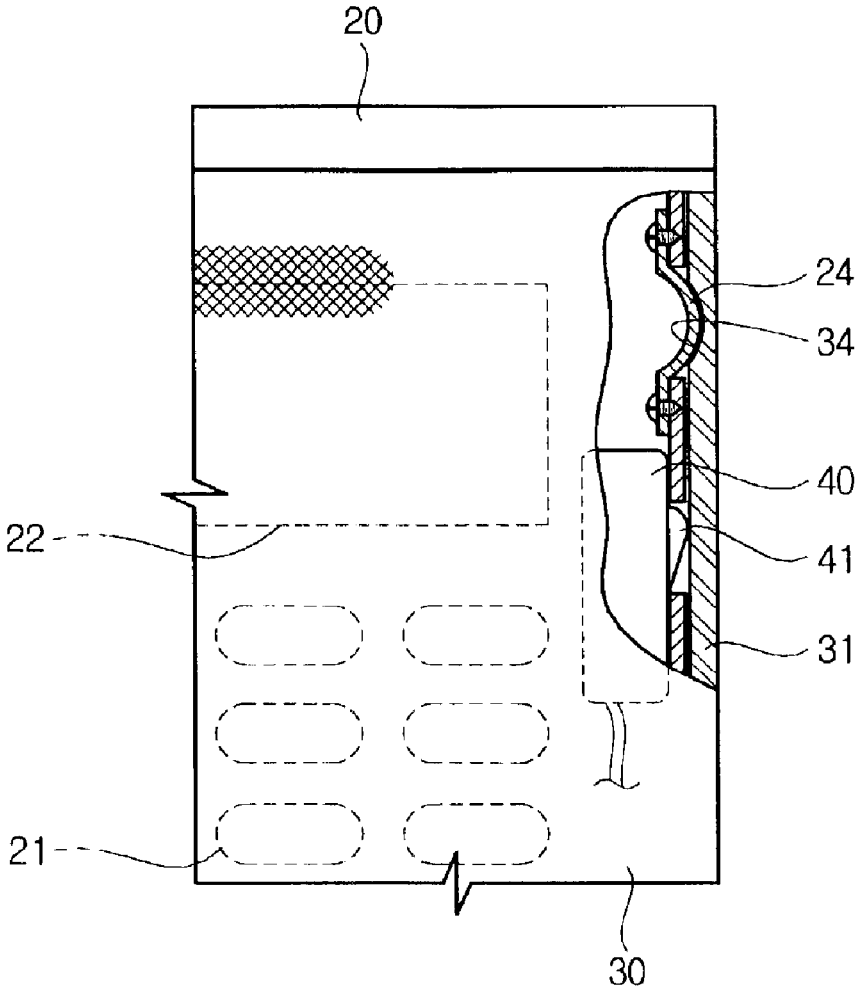
FIG. 6 is a sectional view illustrating the power switch and the locking projection which are provided at the control panel of the microwave oven of FIG. 1, when the cover unit is the closed position.

As illustrated in FIGS. 5 and 6, locking projections 24 of predetermined elasticity are provided at both sides of the upper portion of the control panel 20 to hold the cover unit 30 when the cover unit 30 moves upward to cover the upper portion of the control panel 20 which is provided with the control buttons 21 and the display 22. As illustrated in the drawings, each locking projection 24 may be separately manufactured using a leaf spring, and then may be mounted to the control panel 20. Alternatively, the locking projections 24 may be mounted to the sides of the control panel 20 in such a way as to be integrated with the control panel 20. Further, locking grooves 34, each having a predetermined depth, are provided on inner surfaces of the bent parts 31 of the cover unit 30 to engage with the locking projections 24. Such a construction prevents the cover unit 30 from being undesirably moved downward due to gravity when a user pushes the cover unit 30 up to cover the control buttons 21.

A power switch 40 is installed on a side of the upper portion of the control panel 20. The power switch 40 shuts off the power when the cover unit 30 moves upward to cover the control buttons 21, and supplies power to the microwave oven when the cover unit 30 moves downward to open the control buttons 21. A push part 41 is provided at a predetermined position of the power switch 40, and is projected from the side of the upper portion of the control panel 20 in such a way as to be exposed to the outside.

When the cover unit 30 moves upward to cover the control buttons 21, the push part 41 of the power switch 40 is depressed by an inner surface of one of the bent parts 31 of the cover unit 30, thus shutting off power. Meanwhile, when the cover unit 30 moves downward to open the control buttons 21, the push part 41 of the power switch 40 is released, thus supplying power to the microwave oven.

That is, according to the present invention, when the microwave oven is not operated, the cover unit 30 is pushed up to cover the control buttons 21, thus preventing the control buttons 21 from becoming dirty, and thus preventing the microwave oven from being carelessly operated by children. Further, when the cover unit 30 covers the control buttons 21, the power switch 40 shuts off power, thus preventing electric power from being undesirably wasted.

As apparent from the above description, the present invention provides a microwave oven which is designed such that control buttons are either exposed or hidden by a cover unit which is provided at a control panel, thus preventing the control buttons from being contaminated due to dust in a room when the microwave is not in use, and preventing the microwave oven from being carelessly operated by children.

Further, according to the present invention, when the cover unit closes the control buttons, a power switch shuts off power, thus preventing electric power from being undesirably wasted.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microwave oven, comprising:

a control panel provided with a plurality of control buttons;

a cover unit mounted to the control panel to open or close a predetermined portion of the control panel in which the control buttons are provided; and a power switch to supply power to the microwave oven or shut off the power depending on whether the cover unit is opened or closed.

2. The microwave oven according to claim 1, wherein said control buttons are provided on either upper or lower portions of a front surface of the control panel, and said cover unit has a size larger than a size of the portion of the control panel with the control buttons.

3. The microwave oven according to claim 2, further comprising an elevation unit to move said cover unit up and down to cover and uncover said control panel.

4. The microwave oven according to claim 3, wherein said elevating unit comprises:

guide grooves longitudinally formed along both sidewalls of the control panel;

bent parts formed by bending both side edges of the cover unit to cover the sidewalls of the control panel; and guide rails formed by bending edges of the bent parts to engage with the guide grooves.

5. The microwave oven according to claim 3, further comprising:

a locking projection having predetermined elasticity provided at an upper portion of the control panel to hold the cover unit when the cover unit is moved upward; and a locking groove provided on an inner surface of the cover unit to engage with the locking projection.

6. The microwave oven according to claim 1, wherein said power switch is depressed by the cover unit when the cover unit covers the control buttons, so that power to the microwave is shut off.

7. The microwave oven according to claim 6, wherein the power switch is positioned on a side of the upper portion of the control panel.

8. The microwave oven according to claim 6, wherein the power switch comprises a push part projecting from the side of the upper portion of the control panel and exposed externally.

9. A microwave oven, comprising:

a control panel provided with a plurality of control buttons;

a cover unit slidably mounted to the control panel to open or close a predetermined portion of the control panel in which the control buttons are provided; and a power switch to supply power to the microwave oven or shut off power depending on whether the cover unit is opened or closed.

10. A microwave oven, comprising:

a control panel to control the microwave oven; and an exposure unit to expose the control panel and supply power to the microwave simultaneously, or hide the control panel and shut off power to the microwave simultaneously.

11. The microwave according to claim 10, wherein the exposure unit comprises a cover to slide between a first position to hide the control panel and a second position to expose the control panel.

12. The microwave according to claim 11, further comprising locking projections provided at both sides of an upper portion of the control panel to hold the exposure unit when positioned to cover the control panel.

13. The microwave according to claim 12, wherein the locking projections are separately manufactured and formed of a leaf spring.

14. The microwave according to claim 12, wherein the locking projections are integrally formed on the sides of the control panel.

* * * * *